US011229834B2

(12) United States Patent
Keller Carlquist

(10) Patent No.: US 11,229,834 B2
(45) Date of Patent: Jan. 25, 2022

(54) PORTABLE GAME DEVICE

(71) Applicant: Ionized Game Design AB, Stockholm (SE)

(72) Inventor: Pål Keller Carlquist, Stockholm (SE)

(73) Assignee: Ionized Game Design AB, Stockholm (SE)

( * ) Notice: Subject to any disclaimer, the term of this patent is extended or adjusted under 35 U.S.C. 154(b) by 0 days.

(21) Appl. No.: 15/733,020

(22) PCT Filed: Sep. 28, 2018

(86) PCT No.: PCT/EP2018/076439
§ 371 (c)(1),
(2) Date: Mar. 27, 2020

(87) PCT Pub. No.: WO2019/063781
PCT Pub. Date: Apr. 4, 2019

(65) Prior Publication Data

US 2020/0230491 A1 Jul. 23, 2020

(30) Foreign Application Priority Data

Sep. 28, 2017 (SE) ..... 1751202-1

(51) Int. Cl.
*A63F 3/00* (2006.01)

(52) U.S. Cl.
CPC .. *A63F 3/0023* (2013.01); *A63F 2003/00246* (2013.01)

(58) Field of Classification Search
CPC ..... A63F 3/0023
USPC ..... 273/155; 446/487
See application file for complete search history.

(56) References Cited

U.S. PATENT DOCUMENTS 636,109 A * 10/1899 Bowers ..... A63F 9/0823 273/155
2,680,935 A * 6/1954 Smart ..... A63H 33/16 446/382
2,883,195 A * 4/1959 Rogers ..... A63F 9/088 273/155
3,971,156 A * 7/1976 Lamlee ..... A63H 33/16 446/488
4,142,321 A * 3/1979 Coppa ..... A63H 33/16 273/155
4,323,244 A * 4/1982 Busing ..... A63F 9/12 156/73.1
4,722,712 A * 2/1988 McKenna ..... A63H 33/10 273/155
4,875,681 A * 10/1989 Ofir ..... A63F 9/088 273/155
5,192,077 A * 3/1993 Caicedo ..... A63F 9/088 273/155

(Continued)

OTHER PUBLICATIONS

Wikipedia Kaleidocycle, https://en.wikipedia.org/wiki/Kaleidocycle, Apr. 2021.*

*Primary Examiner* — William M Pierce
(74) *Attorney, Agent, or Firm* — Ziolkowski Patent Solutions Group, SC

(57) ABSTRACT

A portable game device for use when playing a game according to game rules, said game device comprising a kaleidocycle comprising a plurality of n-gon bodies hingedly joined to form a ring of said n-gon bodies wherein a plurality of said n-gon bodies each comprise a surface member provided with game graphics related to said game rules.

4 Claims, 2 Drawing Sheets

(56) References Cited

U.S. PATENT DOCUMENTS

| | | | | |
|---|---|---|---|---|
| 5,735,520 | A * | 4/1998 | Matos | A63F 9/088 273/155 |
| 6,386,541 | B1 * | 5/2002 | Cornelius | A63F 9/088 273/155 |
| 6,523,826 | B1 * | 2/2003 | Matos | A63F 9/0613 273/155 |
| 2005/0230911 | A1 * | 10/2005 | Blake | A63F 3/04 273/236 |
| 2009/0072483 | A1 * | 3/2009 | Salomon | A63F 3/00 273/308 |

* cited by examiner

PORTABLE GAME DEVICE

TECHNICAL FIELD

The present inventive concept generally relates to a portable game device.

BACKGROUND

Normal game boards, such as cardboard game boards, are often quite large in order to fit many graphical elements relating to game rules. These boards are due to their size typically unsuitable for being carried around. Some game boards exhibit loose pieces of graphics which can be lifted and moved about, rotated or turned to change the graphics and thereby affect the basis for the game set by the game board. For example, a road of the game could suddenly change direction or be blocked due to rotation of a piece of graphics. There is always a risk of losing the piece of graphics, especially when playing on the move.

Thus, an object of the invention is to provide for a more portable game experience.

SUMMARY

It would be advantageous to achieve a game device addressing one or more of the above mentioned issues. In particular, it would be desirable to obtain a game device allowing a more portable gaming experience.

To better address one or more of the above-mentioned issues, a portable game device having the features defined in the independent claim is provided. Preferable embodiments are defined in the dependent claims.

According to an aspect of the present inventive concept a portable game device is provided for use when playing a game according to game rules. Said game device comprises a kaleidocycle comprising a plurality of n-gon bodies hingedly joined to form a ring of said n-gon bodies wherein a plurality of said n-gon bodies each comprise a surface member provided with game graphics related to said game rules.

By providing a kaleidocycle as a carrier of game graphics, a large total game graphics carrier surface may be provided in a small format, whilst ensuring that game graphics carrier can easily be switched between different configurations, each configuration showing various portions of the game graphics carrier whilst hiding and preventing other portions of the game graphics carrier to be shown. Thus, a portable game device is achieved, suitable for playing board game-like games. So hiding portions of the game graphics carrier decreases the risk of someone spotting and remembering the game graphics displayed on the hidden sides, and thereby increases game dynamics compared to a regular old-fashioned cardboard game board for which all game graphics is typically shown on the laid open flat game board. By simply rotating the kaleidocycle to a new configuration, the joint surface shown is changed and the game can continue using the revealed surfaces, whilst other surfaces are hidden. That said, the game device may either be used as game board onto which game pieces are placed and moved, or it can be used as a reconfigurable dynamic game piece.

At least one of said surface members of at least one of said n-gon bodies may comprise an opening, wherein a cover member is provided at each opening for covering at least a portion of said opening. Said cover member is sized and shaped to fit within said opening such that the cover member is rotatable within said opening to show any one of a first and a second surface of the cover member. The cover member is rotatably attached to the n-gon body such that the cover member is rotatable about a rotational axis to alternatively shown any one of the first and second surfaces. The provision of such a cover member enables change of the displayed game graphics of the current configuration shown by rotation of the cover member. Since each n-gon body has an inner space and the cover member turns one of its first and second sides into said space, the side turned towards the inner space is not visible for the people playing the game. Thus, the game can be played standing up holding the game device in the air without revealing both sides of the cover members. This provides for increased game dynamics in a portable format.

The cover member may be rotatably attached to the n-gon body by means of a first and a second connection means respectively provided at opposite outer portions of the cover member for jointly defining its rotational axis, each connection means comprising a protrusion provided at either the cover member or the n-gon body, and a matching recess provided on the other one of the cover member and the n-gon body. The respective protrusion fit rotatably into the respective recess to provide for rotational engagement between cover member and n-gon body. Such connection means can easily be added to the cover member and to the n-gon body and are suitable for injection molding and thereby mass production. No further parts are needed to establish rotational engagement between cover member and n-gon body. The shape of the opening may be symmetric about the rotational axis. The symmetry allows the cover member to fill the whole of, or an equal amount of, the opening of the n-gon body no matter what side of the cover member body is shown.

The n-gon bodies and the cover members may be provided with a metal layer, and the game pieces provided with magnets configured strong enough to hold the respective game piece to the metal layer. The metal layer and the magnets of the game pieces, provides a convenient means for the game pieces to be attached to the n-gon bodies without falling off.

Further objects, features and advantages of the present invention will become apparent from the following detailed description, the drawings and the appended claims. Those skilled in the art will realize that different features of the present invention may be combined to create embodiments other than those described.

BRIEF DESCRIPTION OF THE DRAWINGS

In the drawings like reference numerals will be used for like elements unless stated otherwise.

FIGS. 1-7 show the game device rotated to a state in a first configuration with side members jointly displaying a first set of surfaces.

FIGS. 8-16 show the game device rotated to a state between two configurations.

FIGS. 1, 2 and 4-7 show various projected views based on the view of FIG. 3 (with FIG. 7 rotated).

FIGS. 8-11 and 13-16 show various projected views based on the view of FIG. 12.

FIG. 12 is marked with a first set of surface members 2*a*-7*a* and a second set of surface members 2*b*-7*b*, each set respectively belonging to two different configurations.

FIG. 17 shows the game device as in FIG. 15 in greater detail to highlight the first and second connection means.

| | |
|---|---|
| 1 | portable game device |
| 2 | first n-gon |
| 3 | second n-gon |
| 4 | third n-gon |
| 5 | fourth n-gon |
| 6 | fifth n-gon |
| 7 | sixth n-gon |
| 8 | opening |
| 9 | cover member |
| 10 | rotational axis |
| 11 | first connection means |
| 12 | second connection means |

DETAILED DESCRIPTION OF EMBODIMENTS

The invention will hereinafter be described in more detail with reference to the accompanying drawings. The invention may however be embodied in many different forms and should not be construed as limited to the embodiments set forth herein; rather, these embodiments are provided for thoroughness and completeness, and fully convey the scope of the present aspects to the skilled person.

The kaleidocycle is a three-dimensional ring. The simplest form of a kaleidocycle is composed of a ring of an even number of n-gon bodies 2-7 formed as tetrahedrons (pyramids). The n-gon bodies 2-7 are connected on perpendicular edges to form the kaleidocycle. This design is unique, at least due to its dynamic capability: the n-gon bodies 2-7 are rotatable around the ring itself. Thus, the kaleidocycle may be operated by twisting it around itself. When twisting it inwards or outwards it shows different surfaces of each n-gon body 2-7. A group of simultaneously displayed n-gon body 2-7 faces together define a so called joint surface.

Figure 6:
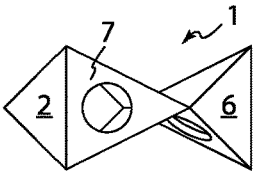
Figure 7:
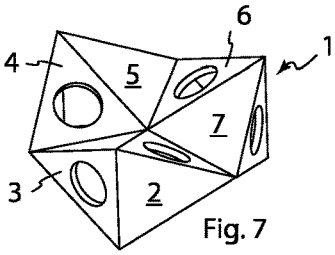
Figure 8:
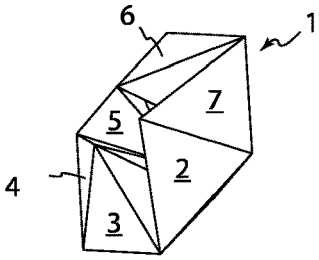
Figure 9:
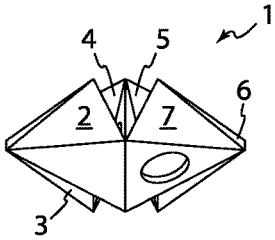
Figure 10:
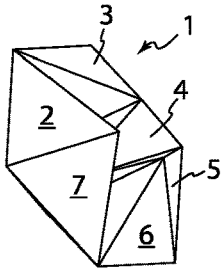
Figure 11:
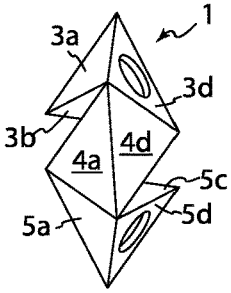
Figure 12:
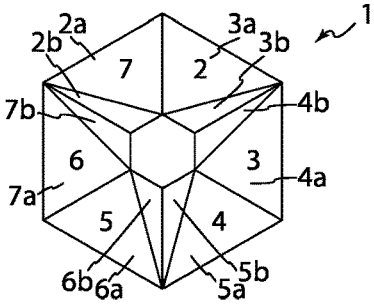
Figure 13:
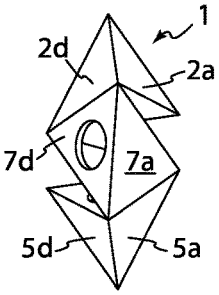
Figure 14:
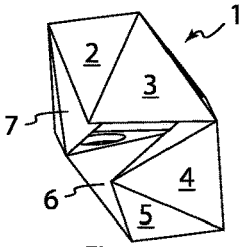
Figure 15:
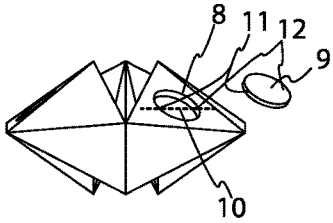
Figure 16:
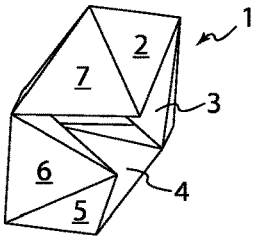
Figure 17:
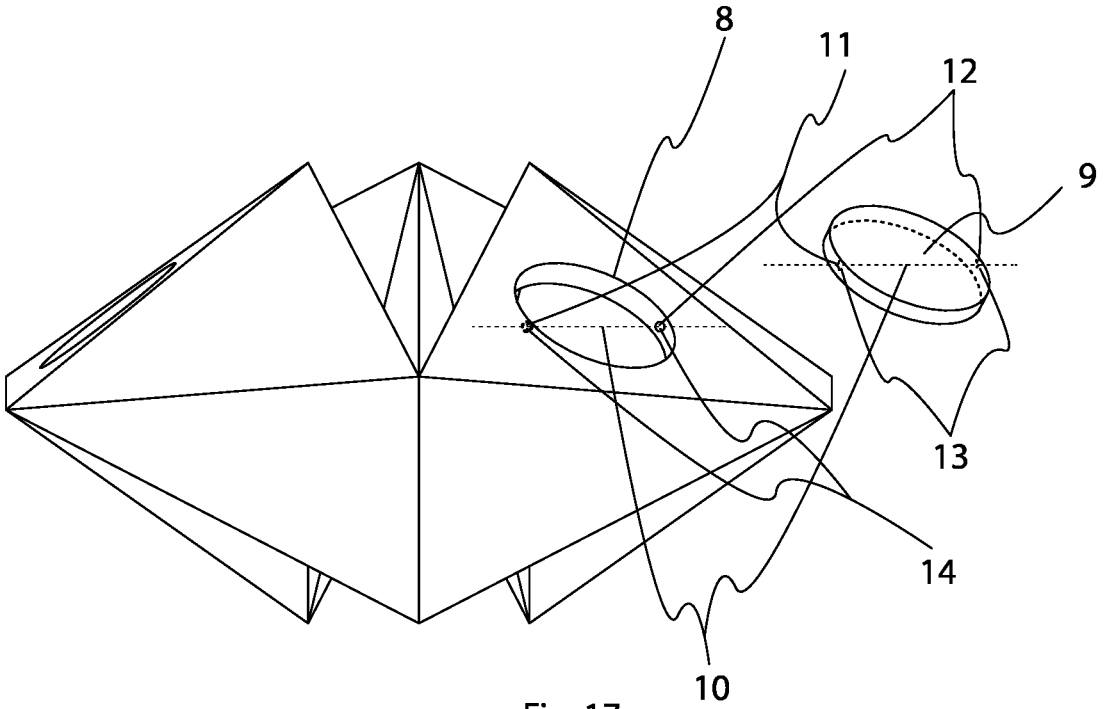

By the term "n-gon body 2-7" is hereby meant a body of the kaleidocycle with n number of surfaces. The body may comprise at least four surface members. These surface members together define an inner space of the n-gon body 2-7, as shown in FIGS. 6 and 7 where the inner space is visible through the holes. A kaleidocycle comprises at least six n-gon bodies 2-7.

Figure 1:
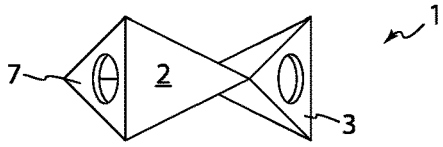
FIGS. 1-17 show a game device according to a first embodiment of the invention (shown without its cover member, however in FIG. 15 with a cover member detached).
Figure 2:
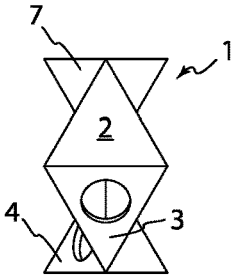
Figure 3:
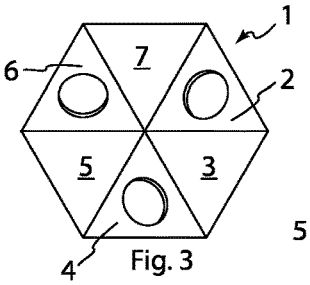
Figure 4:
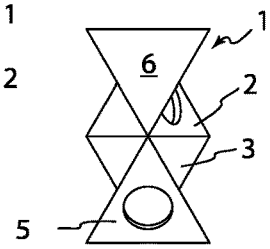
Figure 5:
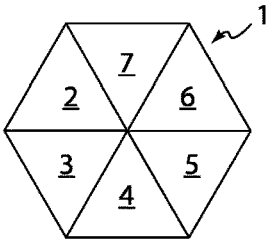

A portable game device 1 according to a first embodiment of the invention is shown in FIGS. 1-16 but without its cover members 9. The game device is for use when playing a game according to game rules and comprises a kaleidocycle comprising a plurality of n-gon bodies 2-7 hingedly joined to form a ring of said n-gon bodies 2-7. A plurality of said n-gon bodies 2-7 each comprise a surface member provided with game graphics (graphics not shown in figures) related to said game rules. The game graphics together with the game rules sets boundaries and logic of the game, similar to classic board games. The game graphics of nearby surface members in a configuration may be arranged such that a joint graphics is created by the graphics of the individual surface members shown in the configuration (See for example FIGS. 3 and 5 showing joint surface members, however without graphics shown). For example, the graphics may show paths or roads continuing between the surface members of nearby n-gons 2-7. By using a kaleidocycle as game graphics carrier, a large total game graphics carrier surface may be provided in a small format, whilst ensuring that game graphics carrier can easily be switched between different configurations showing various portions of the game graphics carrier whilst hiding and preventing other portions of the game graphics carrier to be shown. Thus, a portable game device 1 is achieved, suitable for playing board game-like games. Such hiding decreases the risk of someone spotting and remembering the information displayed on the hidden sides, and thereby increases game dynamics compared to a regular old-fashioned cardboard game board for which all graphics is shown on the laid open flat game board. By simply rotating the kaleidocycle to a new configuration, the joint surface is changed and the game can continue on the revealed surfaces, whilst other surfaces are hidden.

Two of said surface members of two of the n-gon bodies 2-7 comprise an opening 8, wherein a cover member 9 is provided at each opening 8 for covering at least a portion of said opening 8. The openings are circular and the cover members 9 are circular and sized to fit within the respective openings such that the cover members 9 are rotatable within the respective openings to show any one of a first and second opposite surface of the respective cover members 9. The cover members 9 are rotatably attached to the respective n-gon bodies such that the cover members 9 are rotatable about a respective rotational axis 10 to alternatively show any of the first and second surfaces. The provision of such a cover member 9 enables change of the displayed graphics of the current configuration of the game graphics carrier shown by rotation of the cover member 9. Since each n-gon 2-7 has an inner space and the cover member 9 turns one of its first and second sides into said space, the side turned towards the inner space is not visible for the people playing the game. Thus, the game can be played standing up holding the game device in the air without revealing both sides of the cover members 9. This provides for increased game dynamics. In other embodiments, the number of n-gons 2-7 provided with openings and cover members 9 may vary. Also, the number of openings and cover members 9 of each respective n-gon 2-7 may vary.

Each cover member 9 is rotatably attached to the respective n-gon body 2-7 by means of a first 11 and a second connection means 12 respectively provided at opposite outer portions of the cover member 9 for jointly defining its rotational axis. Each connection means 11-12 comprises a protrusion 13 provided at the cover member 9 and a matching recess 14 provided on the n-gon body 2-7. The respective protrusion 13 fit rotatably into the respective recess 14 to provide for rotational engagement between cover member 9 and n-gon body 2-7. Such connection means 11-12 can easily be added to the cover member 9 and to the n-gon body 2-7 and are suitable for injection molding and thereby mass production. No further parts are needed to establish rotational engagement between cover member 9 and n-gon body 2-7. In other embodiments, the recesses 14 and protrusions 13 may switch place. In other embodiments, a separate shaft may be attached to the n-gon 2-7 and the cover member 9 adapted to attach to the shaft for rotation around the shaft.

The n-gon bodies 2-7 and the cover members 9 are provided with a metal layer and the game pieces provided with magnets configured strong enough to hold the respective game piece to the metal layer. In other embodiments, no such attachment means is provided for holding the game pieces to the kaleidocycle.

An advantage of the hollow kaleidocycle is that game pieces may be stored inside the kaleidocycle when the game device is not in use.

Specific embodiments of the invention have now been described. However, several alternatives are possible, as would be apparent for someone skilled in the art.

The person skilled in the art realizes that the present invention is not limited to the embodiments described above. Many modifications and variations are possible within the scope of the appended claims. The mere fact that certain measures are recited in mutually different dependent claims does not indicate that a combination of these measures cannot be used to advantage. Any reference signs in the claims should not be construed as limiting the scope of protection.

The invention claimed is:

1. A portable game device for use when playing a game according to game rules, said game device comprising a kaleidocycle comprising a plurality of n-gon bodies hingedly joined to form a ring of said n-gon bodies, wherein a plurality of said n-gon bodies each comprise a surface member provided with game graphics related to said game rules, wherein at least one of said surface members of at least one of said n-gon bodies comprises an opening, wherein a cover member is provided at each opening for covering at least a portion of said opening, wherein said cover member is sized and shaped to fit within said opening such that the cover member is rotatable within said opening to show any one of a first and a second surface of the cover member, wherein the cover member is rotatably attached to the n-gon body such that the cover member is rotatable about a rotational axis to alternatively show any of the first and second surfaces.

2. A portable game device of claim 1, wherein the cover member is rotatably attached to the n-gon body by a first and a second connection respectively provided at opposite outer portions of the cover member for jointly defining its rotational axis, each connection comprising a protrusion provided at either the cover member or the n-gon body, and a matching recess provided on the other one of the cover member and the n-gon body.

3. A portable game device of claim 1, wherein the shape of the opening is symmetric about the rotational axis.

4. A portable game device according to claim 1, further comprising a plurality of game pieces configured to be placed in various positions on said kaleidocycle.

* * * * *